US005114017A

United States Patent [19]

Doyel

[11] Patent Number: 5,114,017

[45] Date of Patent: May 19, 1992

[54] SHOE ORGANIZER

[76] Inventor: John S. Doyel, 404 W. 20th St., New York, N.Y. 10011

[21] Appl. No.: 680,803

[22] Filed: Mar. 7, 1991

[51] Int. Cl.[5] ..... A47F 7/00

[52] U.S. Cl. ..... 211/34; 211/118

[58] Field of Search ..... 211/34, 37, 38, 113, 211/118; 248/317, 324, 309.1

[56] References Cited

U.S. PATENT DOCUMENTS

| | | | |
|---|---|---|---|
| 1,270,811 | 7/1918 | Garant | 211/34 |
| 2,613,816 | 10/1952 | Sibcca | 211/34 |
| 3,292,794 | 12/1966 | Lowe | 211/34 |
| 3,414,093 | 12/1968 | Chostner | 211/34 X |
| 3,635,353 | 1/1972 | Matsubara | 211/34 |
| 3,775,794 | 12/1973 | Fisher | 211/34 X |
| 4,008,807 | 2/1977 | Phillips | 211/34 |
| 4,168,871 | 9/1979 | Dierkes | 211/34 X |
| 4,768,657 | 9/1988 | Lonow | 211/113 X |

*Primary Examiner*—Robert W. Gibson, Jr.
*Attorney, Agent, or Firm*—Peter A. Luccarelli, Jr.

[57] ABSTRACT

A shoe organizer for organizing shoes in stacked, over-and-under pairs along a horizontal shelf or one or more pairs vertically in string-like fashion. The shoe organizer comprises first and second shoe holders which can function as shoe trees, each having a heel piece and a toe piece; a cross bridge connected to the shoe holders; and first and second hook-retaining formed holes on opposite ends of the shoe organizer for attachment of a plurality of shoe organizers to each other in string-like fashion. Vertical stringing of a plurality of shoe organizers is accomplished by inserting one end of a double ended hook into a formed hole of one shoe organizer and inserting the second end of the double-sided hook into a formed hole of a second shoe organizer. The top-most hook end may be hooked over a closest hanger rod or the like.

20 Claims, 3 Drawing Sheets

SHOE ORGANIZER

BACKGROUND OF THE INVENTION

Field of the Invention

The present invention is directed to shoe organizers and particularly to shoe organizers for closets that store matched pairs of shoes in a minimized volume of space.

Desirably, for longer shoe life, shoes should be stored on shoe trees so that the bottoms are stretched in a generally flat fashion and wrinkles are minimized in the toe box of the shoe.

An age-old problem faced by shoe owners is how to store shoes in matched pairs in a minimum volume of space, in a manner which allows quick access to the shoes. The problem is compounded when the owner has more than one pair of shoes.

Unorganized shoes always seem to wind up in a random pile. In such situations it is extremely difficult to find a matched pair quickly. It is also noted that shoes in a pile appear to take up a greater volume of space than shoes which are neatly stacked. While reasonable attempts can be made to maintain loose shoes in neat grids on a floor or shelf, such organization arrangements require a dedicated area per pair of shoes. Any attempt to stack loose shoes in a stack will eventually result in an unorganized pile. Similarly, attempts to remove loose shoes from the bottom of the shoe stack will also result in a pile of loose shoes.

Shoe organizer devices fall into two categories—horizontal shelf or floor organizing devices and vertical organizing devices, which are often hung on a vertical surface or from a closet hanger rod.

One type of known horizontal shoe organizer is a shoe box. One or more pairs of shoes may be stored in a box and a plurality of boxes may be stored in matrix-like fashion. Removal of one box from the box matrix disturbs the entire array. Another type of horizontal organizer is a partitioned container or plurality of partitioned shelves.

Known vertical-type shoe organizers include partitioned containers or flat sheets having pockets for insertion of shoes therein. These vertical organizers are attached to a vertical surface, such as a wall or door, or they are hung from a closet hanger rod.

Compartmentalized horizontal or vertical organizers in and of themselves require purchase of separate shoe trees, if the shoe owner wants to stretch the shoes for longer shoe life.

Another type of known shoe organizer has a pair of fixed-length shoe holders attached to each other in opposed fashion, so that the toe of one shoe is proximal the heel of the other shoe, with the sole portions of both shoes projecting outwardly from the device. This device prevents separation of paired shoes, but does not provide for stacking of multiple pairs of shoes and must be used in conjunction with other types of horizontal or vertical shoe organizers if shoe stacking is desired.

SUMMARY OF THE INVENTION

It is an object of the present invention to create a shoe organizer which holds a pair of shoes.

It is an additional object of the present invention to create a shoe organizer which provides a shoe owner with an option of selectively stacking a single pair of shoes on top of each other for alignment on a horizontal surface or vertically stringing a plurality of pairs of shoes on shoe organizers of the present invention, so that they may be hung on a vertical surface or from a hanger rod.

It is an object of some embodiments of the present invention to create a shoe organizer which stretches shoe bottoms for longer shoe life.

These objects are attained by the shoe organizer of the present invention, which retains pairs of shoes so that they are not inadvertently separated and affords the shoe owner flexibility in deciding whether to utilize the device for horizontal or vertical shoe organization.

The present invention features a shoe organizer comprising first and second shoe holders, each having a heel piece and a toe piece. The shoe organizer has a cross bridge connected to the shoe holders and first and second retaining means for attachment of a plurality of shoe organizers to each other in string-like fashion with double-ended hooks or like devices, on opposite ends of the shoe organizer.

The shoe organizer of the present invention may feature first and second shoe holders, each having a heel piece, a toe piece and a shoe holder adjuster for selectively varying holder length, with the shoe holders oriented in opposed relationship so that the first holder toe piece is opposite the second holder heel piece. This embodiment of the shoe organizer includes a cross bridge connected to each of the shoe holders, having means for selectively varying width thereof. This embodiment of the shoe organizer of the present invention has first and second retaining means for attachment of a plurality of shoe organizers to each other in string-like fashion, attached to the first and second shoe holder heel pieces. The retaining means may comprise formed holes in the heel pieces for stringing of a plurality of shoe organizers to each other with hooks or like devices.

The shoe organizer of the present invention may also feature first and second shoe holders, each having a heel piece with a first shank portion and a second shank portion attached to the first shank portion at an angle diverging therefrom, which can be biased toward the first shank, and a toe piece. The shoe holders are oriented in opposed relationship so that the first holder toe piece is opposite the second holder heel piece. This embodiment of the present invention has a shoe holder adjuster for selectively varying holder length, including a channel attached to each of the respective toe pieces for selective slidable insertion of the respective heel piece first shank portion therein and means for locking the respective channel and first shank portions relative to each other. This embodiment of the present invention has a cross bridge connected to each respective first shank portion, having means for selectively varying width thereof, including a first track portion attached to the first shoe holder, a second track portion attached to the second shoe holder, an elongated slot defined by each respective track portion and means for clamping the first and second track portions relative to each other that is retained within each of the respective slot portions. The shoe organizer of this embodiment also has first and second hook retaining formed holes attached to each respective first and second heel piece on each respective second shank portion.

BRIEF DESCRIPTION OF THE FIGURES

FIG. 5 is a front elevational view of a plurality of shoe organizers of FIG. 1 attached to each other in string-like fashion to hang shoes vertically from a hanger rod or the like.

DESCRIPTION OF THE PREFERRED EMBODIMENTS

The following embodiments of the invention described herein are for illustrative purposes only and are not intended to restrict the scope of the invention as defined by the accompanying claims.

Figure 1:
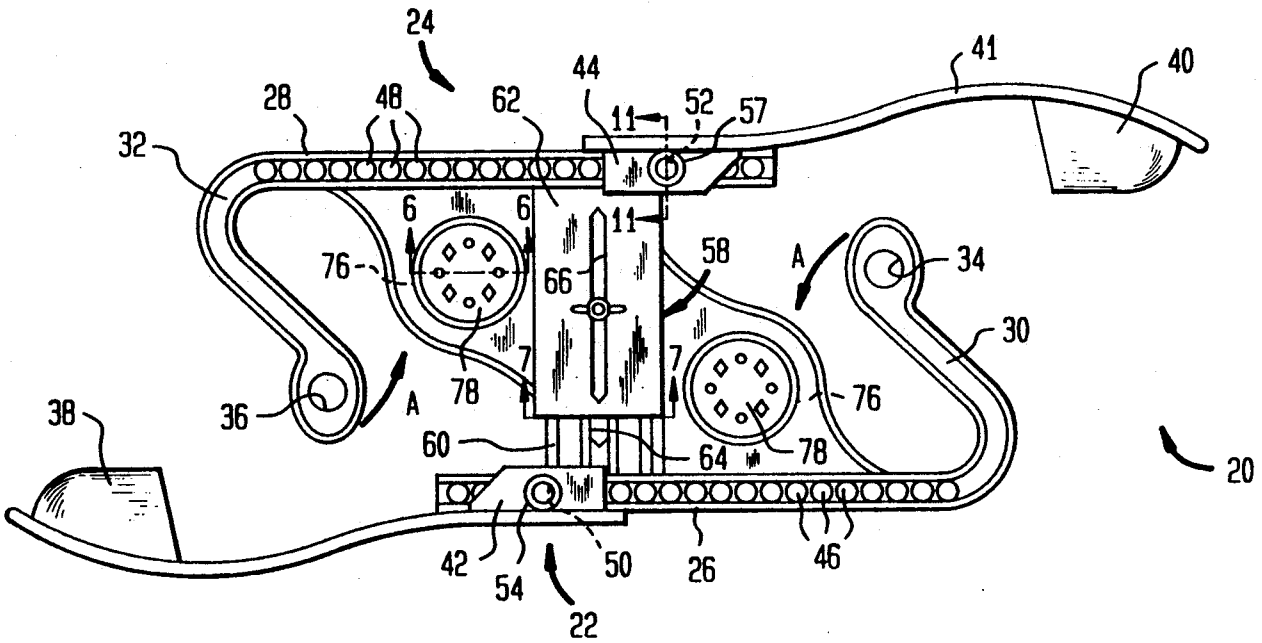
FIG. 1 is a front elevational view of the shoe organizer of the present invention.

The shoe organizer of the present invention 20 is shown in FIG. 1. It has first and second shoe holders 22,24, each of which have corresponding components described herein that may have identical construction.

The first and second shoe holders 22,24 have heel pieces with first shank portions 26,28 and second shank portions 30,32 that are attached to the respective first shank portions at an angle diverging from the first shank. The second shank portions 30,32 can be biased toward the first shank portions 26,28 as shown by the arrows A in FIG. 1. Desirably, the first 26,28 and second 30,32 shank portions are of unitary construction and have an I-beam-like cross section with a flange and two web portions (see, e.g., 28*a*,28*b* and 28*c*, respectively of FIG. 11).

The second shank portions 30,32 have formed holes 34,36, respectively, which are utilized to receive attachment elements, such as double-ended hooks, string, carabineers, eye hooks or the like, for attaching a plurality of organizers to each other in string-like fashion, as will be described herein. It is contemplated that any kind of elements which provide for interconnection of a plurality of shoe organizers may be substituted for the formed holes 34,36 and attachment elements. Examples can include ball and socket joints, hasps or hooks molded directly into the shoe organizers or otherwise connected thereto.

The first and second shoe holders 22,24 have first and second toe pieces 38,40, respectively. Each toe piece 38, 40 has a channel 42,44 for slidable receipt of the respective first shank portion 26,28 therein.

Figure 4:
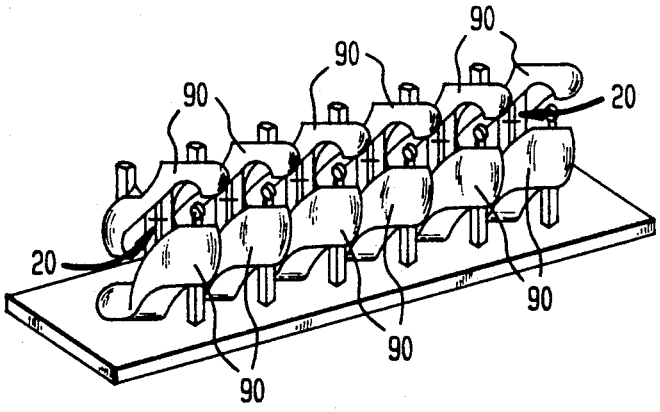
FIG. 4 is a perspective view of a plurality of shoe organizers of FIG. 1 being utilized to store shoes on a shelf.

While it is possible to construct the shoe holder heel pieces and toe pieces as a single, unitary unit, such as by forming a unitary molding or by permanently attaching the toe and heel pieces together as a single-length unit, it is desirable to construct each shoe holder to allow for adjustment of length, for more ideal fitting to different size shoes. It is also desirable for the shoe holder to provide a tension force on a shoe attached to the holder for longer shoe life and for alleviating wrinkling of shoe material in the toe area. In this manner, the shoe holder can perform the same function as a shoe tree. Also, by tensioning the shoes in the shoe holders, they may be stacked in over-and-under fashion as shown in FIG. 4.

Figure 11:
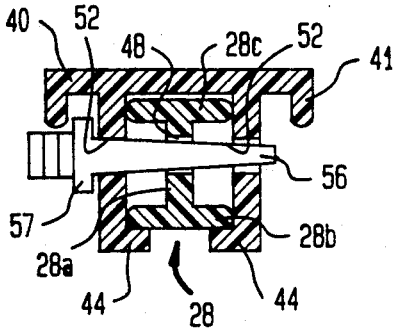
FIG. 11 is an elevational cross section taken along 11—11 of FIG. 1.
Figure 6:
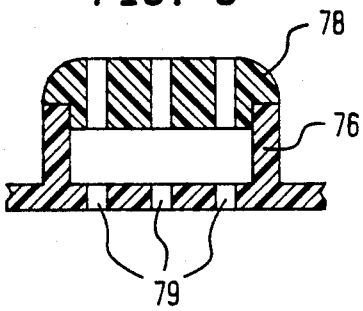
FIG. 6 is a side elevational, sectional view of a container mounted on the shoe holder taken along 6—6 of FIG. 1.

In order to provide for shoe holder length adjustment and shoe tension, the shoe holder first shank portions 26,28 each define a plurality of hole arrays 46,48 respectively, in each shank web portion. Referring to FIGS. 1 and 11, each of the toe piece channels 42,44 have a pin apertures 50,52 for passage of a tapered pin 54,56, respectively. Pins 54,56 lock the relative position of the first shank portions 26,28 and toe piece channels 42,44 by insertion through the pin apertures 50, 52 and one of the holes of the hole arrays 46,48. If the heel pieces are constructed of molded plastic, it is desirable to construct the first shank portions 26, 28 with slots between each pair of holes in the hole arrays 46,48 for easier removal of the completed heel piece from the mold halves and to enable a tight interference fit with the pin 54 or 56. As is shown in FIG. 11, the pins, such as pin 56 can be constructed with a radial skirt 57 that engages with lip 41 on toe piece 40, to prevent inadvertent separation of the pin from the holes 48.

While the preferred embodiment of shoe holder 22,24 length adjuster is as described above, other types of length adjuster may be utilized. For example, the first shank portions 26,28 may be constructed with ratchet teeth and a pawl mechanism may be attached to the toe piece channels 42,44 for engagement with the ratchet teeth. Similarly, a clamping device, such as a screw and wing nut may be attached to the channels 42,44 to provide a clamping force on the first shank portions 26,28. Also, the shoe holders may be constructed so that there is a biasing spring within the channels 42,44 which would urge the heel pieces away from the toe pieces 38,40 and tension a shoe placed on the shoe holder.

Referring to FIG. 1, the shoe organizer 20 has a cross bridge 58 that attaches the two shoe holders 22,24 to each other in opposed relationship, so that the toe piece 38 faces the heel piece 28, allowing for a more compact storage volume for each pair of shoes attached thereto. However, the cross bridge 58 may be constructed to orient each of the shoe holders 22,24 in any desired position.

Figure 7:
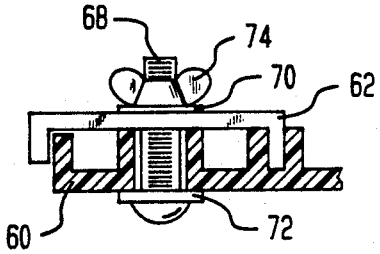
FIG. 7 is a side elevational, sectional view of cross bridge width adjustment tracks taken along 7—7 of FIG. 1.

It is preferred that the cross bridge 58 be adjustable to provide for different sizes of shoes, especially for different heel heights. Accordingly, the cross bridge 58 has a first track 60 and a second track 62, with slots 64,66, respectively. A suggested cross section of each of tracks 60,62 is shown in FIG. 7. The first and second tracks 60,62 are clamped relative to each other by machine screw 68, washers 70,72 and wing nut 74. Any other form of known clamping or locking structure may be substituted for the cross bridge adjustment feature, such as for example a channel, shank and locking structure as described in connection with the shoe holders 22,24 length adjusters.

If desired, the shoe organizer 20 may include one or more compartments 76 for holding a fragrance, deodorizing chemical or the like to freshen shoes, with vented caps 78 and compartment vents 79. The compartments 76 may be provided on one or both sides of the shoe organizer, as desired.

Figure 2:
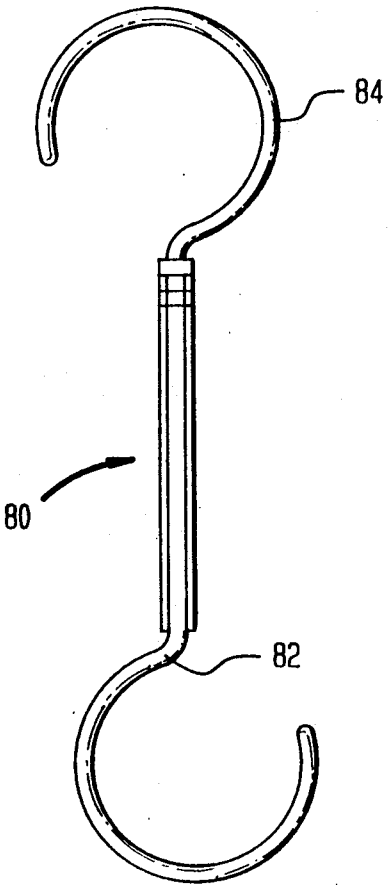
FIG. 2 is a front elevational view of a double-ended hook of the present invention.
Figure 10:
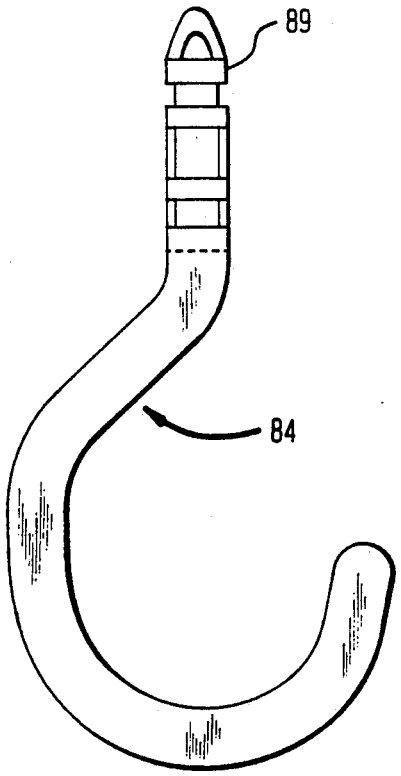
FIG. 10 is a front elevational view of a second portion of the double-ended hook of FIG. 2.
Figure 8:
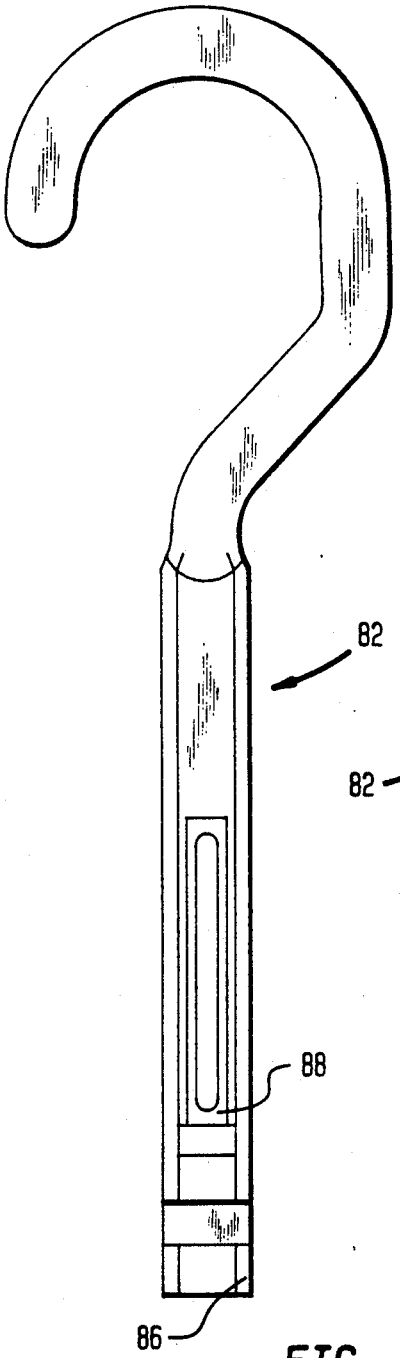
FIG. 8 is a front elevational view of a first portion of the double-ended hook of FIG. 2.
Figure 9:
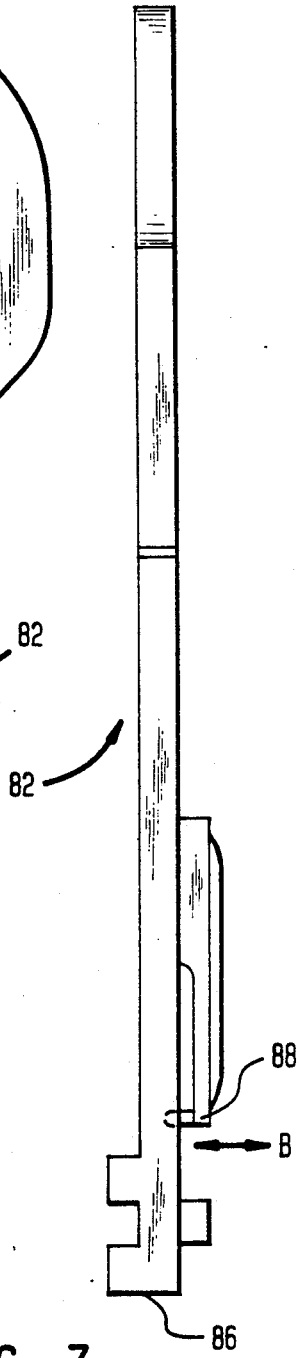
FIG. 9 is a side elevational view of the hook first portion of FIG. 8.

It is preferable to provide the shoe organizer 20 with a double-ended hook 80, shown in FIG. 2. The double-ended hook 80 has a first hook portion 82 and a second hook portion 84 that is rotatively coupled to the first portion. Details of the hook construction are shown in FIGS. 8–10. The hook first portion 82 has a female bore 86 and a biasable tongue 88 that is translatable in the direction of arrow B. A male end 89 of the second hook portion 84 is inserted into the first hook portion female bore 86 and engages the tongue 88 to prevent inadvertent separation of the two hook portions 82,84.

All components of the shoe organizer 20 and double-ended hook 80 are preferably constructed of injection molded plastic, with exception of the machine screw 68, washers 70,72 and wing nut 74. However, if desired, the screw 68, washers 70,72 and wing nut 74 may also be constructed of plastic.

Figure 3:
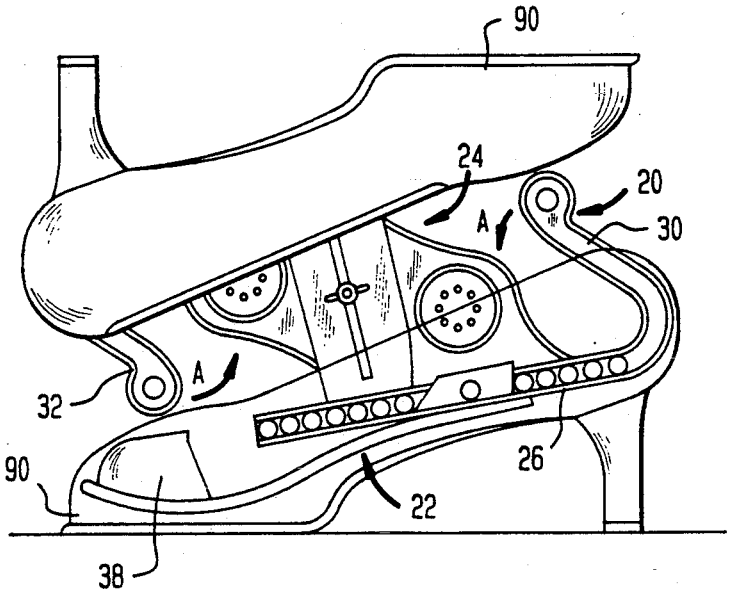
FIG. 3 is a front elevational view of the shoe organizer of FIG. 1, shown with shoes slipped on the shoe holders thereof.
Figure 5:
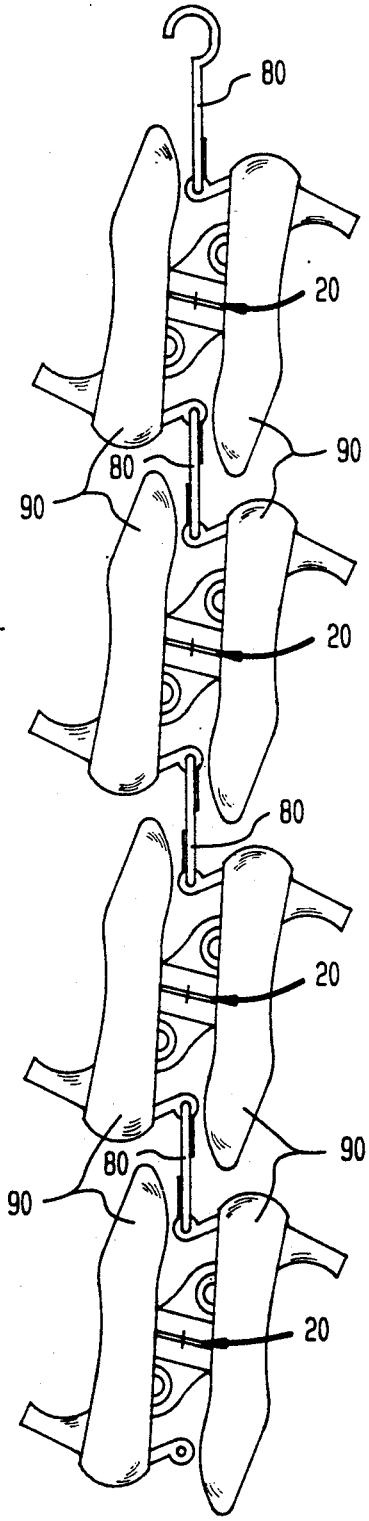

The shoe organizer 20 may be used as suggested in FIGS. 3–5. FIG. 3 shows a pair of shoes 90 being retained by the shoe organizer 20 of the present invention. The user adjusts the length of the shoe holders 22,24 to fit a pair of shoes snugly, in order to provide beneficial tension on the shoe toe boxes and soles. To install a pair of shoes 90 on the shoe holders 22,24, the user biases heel piece second shank portions 30,32 in the direction of the arrows A, i.e., toward the first shank portions 26,28 and slips the shoes over the toe pieces 38,40 and the heel pieces first 26,28 and second 30,32 shanks. When the user releases tension on the second shank portions 30,32 bias tension is exerted on the shoes 90. Now the user has a pair of shoes retained together.

As shown in FIG. 4, pairs of shoes 90 that are retained on shoe organizers may be lined up on a shelf or floor. By stacking each pair of shoes on each other, in over-and-under fashion, floor space required to store a pair is halved. Removal of any selected pair of shoes does not disturb the remaining pairs.

Alternatively, as shown in FIG. 5, the user may hang multiple pairs of shoes in string-like vertical fashion with the same shoe organizer 20, in conjunction with the double-ended hooks 80. The hooks 80 have ends which may swivel relative to each other for maximum flexibility in choosing hook position. The topmost hook 80 may be hung from a closet hanger rod , peg, nail or the like.

A beneficial feature of the present invention is that the user may purchase a single type of shoe organizer and apply it to any desired vertical or horizontal shoe organization format.

While the present invention has been described herein with reference to the preferred embodiments, one skilled in the art will recognize that other variations of the present invention as defined by the claims herein may be practiced.

What is claimed is:

1. A shoe organizer comprising:

first and second shoe holders, each having a heel piece and a toe piece, a cross bridge connected to the shoe holders; and first and second retaining means for attachment of a plurality of shoe organizers to each other in self-supporting, string-like hanging fashion, on opposite ends of the shoe organizer.

2. A shoe organizer comprising:

first and second shoe holders, each having a heel piece and a toe piece;

a cross bridge connected to the shoe holders wherein the shoe holders are attached to the cross bridge in opposed relationship for orienting the first holder toe piece opposite the second holder heel piece; and first and second retaining means for attachment of a plurality of shoe organizers to each other in string-like fashion, on opposite ends of the shoe organizer.

3. A shoe organizer comprising:

first and second shoe holders, each having a heel piece and a toe piece;

a cross bridge connected to the shoe holders, wherein the cross bridge has means for adjusting cross bridge width; and first and second retaining means for attachment of a plurality of shoe organizers to each other in string-like fashion, on opposite ends of the shoe organizer.

4. The shoe organizer of claim 1, wherein the shoe holders have means for adjusting shoe holder length.

5. A shoe organizer comprising:

first and second shoe holders, each having a heel piece and a toe piece, wherein the heel pieces have a first shank portion and a second shank portion attached to the first shank portion at an angle diverging therefrom and biasable toward the first shank;

a cross bridge connected to the shoe holders at each of the first shank portions thereof; and first and second retaining means for attachment of a plurality of shoe organizers to each other in string-like fashion, on opposite ends of the shoe organizer.

6. A shoe organizer comprising:

first and second shoe holders, each having a heel piece and a toe piece;

a cross bridge connected to the shoe holders; and first and second retaining means for attachment of a plurality of shoe organizers to each other in string-like fashion, on opposite ends of the shoe organizer, wherein the first and second retaining means is a formed hole attached to respective first and second heel pieces.

7. The shoe organizer of claim 1, further comprising a compartment for holding at least one of fragrance and deodorizing chemical attached to at least one of the shoe holders.

8. A shoe organizer comprising:

first and second shoe holders, each having a heel piece and a toe piece;

a cross bridge connected to the shoe holders;

first and second retaining means for attachment of a plurality of shoe organizers to each other in string-like fashion, on opposite ends of the shoe organizer; and a double-ended hook for insertion into one of the retaining means.

9. The shoe organizer of claim 8, wherein at least one of the hooks is rotatively attached to the other hook.

10. A shoe organizer comprising:

first and second shoe holders, each having a heel piece, a toe piece and a shoe holder adjuster for selectively varying holder length, with the shoe holders oriented in opposed relationship so that the first holder toe piece is opposite the second holder heel piece;

a cross bridge connected to each of the shoe holders, having means for selectively varying width thereof; and first and second retaining means for attachment of a plurality of shoe organizers to each other in string-like fashion, attached to the first and second shoe holder heel pieces, respectively.

11. The shoe organizer of claim 10, wherein:

the heel pieces have a first shank portion attached to the cross bridge and a second shank portion attached to the first shank portion at an angle diverging therefrom and biasable toward the first shank portion; and the first and second retaining means are formed holes defined by the respective second shank portions distal respective first shank portions.

12. The shoe organizer of claim 11, wherein the first and second shank portions are of unitary construction having a generally I-beam-like cross section.

13. The shoe organizer of claim 11, wherein the shoe holder adjuster includes a channel attached to one of each of the respective toe pieces and heel pieces for selective slidable insertion of the other of the respective toe pieces and heel pieces therein and means for locking position of the heel and toe pieces relative to each other.

14. The shoe organizer of claim 13, wherein the channel is attached to the respective toe pieces and the means for locking is a plurality of holes defined by the heel piece first shank portion and a pin attached to the channel which is selectively insertable through at least one of the first shank holes.

15. The shoe organizer of claim 11, wherein the cross bridge is attached to the first shank portion of each respective heel piece.

16. The shoe organizer of claim 11, wherein the means for selectively varying cross bridge width is a first track portion attached to the first shoe holder, a second track portion attached to the second shoe holder, an elongated slot defined by each respective track portion and means for clamping the first and second track portions relative to each other retained within each of the respective slot portions.

17. The shoe organizer of claim 10 further comprising a double-ended hook for insertion into one of the retaining means.

18. A shoe organizer comprising:

first and second shoe holders, each having a heel piece with a first shank portion and a second shank portion attached to the first shank portion at an angle diverging therefrom and biasable toward the first shank portion, and a toe piece, the shoe holders oriented in opposed relationship so that the first holder toe piece is opposite the second holder heel piece;

a shoe holder adjuster for selectively varying holder length, including a channel attached to each of the respective toe pieces for selective slidable insertion of the respective heel piece first shank portion therein and means for locking the respective channel and first shank portions relative to each other;

a cross bridge connected to each respective first shank portion, having means for selectively varying width thereof, including a first track portion attached to the first shoe holder, a second track portion attached to the second shoe holder, an elongated slot defined by each respective track portion and means for clamping the first and second track portions relative to each other retained within each of the respective slot portions; and first and second hook retaining formed holes attached to each respective first and second heel piece on each respective second shank portion.

19. The shoe organizer of claim 18 further comprising a double-ended hook for insertion into one of the formed holes for attachment of a plurality of shoe organizers to each other in string-like fashion.

20. The shoe organizer of claim 18, further comprising a compartment attached to at least one of the shoe holders.

* * * * *